US006854999B2

(12) United States Patent
Patel et al.

(10) Patent No.: US 6,854,999 B2
(45) Date of Patent: Feb. 15, 2005

(54) ANTI-OVERSTRESS ELECTRICAL CONNECTOR

(75) Inventors: Navin Kanjibhai Patel, Mechanicsburg, PA (US); William Gary Lenker, Marysville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/197,161

(22) Filed: Jul. 17, 2002

(65) Prior Publication Data

US 2004/0014354 A1 Jan. 22, 2004

(51) Int. Cl.[7] ..... H01R 11/22
(52) U.S. Cl. ..... 439/474; 439/596; 439/834
(58) Field of Search ..... 439/834, 835, 439/441, 595, 596, 474

(56) References Cited

U.S. PATENT DOCUMENTS 4,556,264 A * 12/1985 Tanaka ..... 439/62
5,480,320 A * 1/1996 Saimoto ..... 439/474
5,860,837 A * 1/1999 Bock et al. ..... 439/828
6,024,605 A * 2/2000 Beck et al. ..... 439/595

* cited by examiner

*Primary Examiner*—Renee Luebke

(57) ABSTRACT

A connector assembly for connecting an electrical contact to an electrical wire. The connector assembly comprises a housing and anti-overstress members. The housing has a contact chamber that retains an electrical contact. The electrical contact has an elasticity over a range of motion. The anti-overstress member is provided in the contact chamber. The anti-overstress member is positioned within the range of motion to limit deflection of the electrical contact. The connector assembly may also comprise interweaving walls positioned on either side of the electrical contact within the contact chamber. The interweaving walls shield the electrical contact from arcing. The interweaving walls have edges with non-linear contours proximate an open bottom of the housing.

21 Claims, 3 Drawing Sheets

ANTI-OVERSTRESS ELECTRICAL CONNECTOR

BACKGROUND OF THE INVENTION

The present invention generally relate to an electrical connector, and more particularly to an electrical connector that may be used to carry high-voltage power signals.

Electrical connectors are used to connect various forms of electrical and electronic equipment. For example, some electrical connectors connect printed circuit boards to electrical wires, which are used to transfer power to appliances and utilities, such as lighting fixtures or ballasts. Many appliances and utilities require high levels of power to operate. For example, many devices, such as lighting assemblies require high levels of voltage to operate at acceptable levels.

Typical connectors include a housing that retains a plurality of electrical contacts. Each electrical contact has a pin that is received and retained within a receptacle of a printed circuit board. Typically, the connector is a wire/contact interface in which an electrical wire is electrically connected to an appliance or utility. Electrical signals, such as power signals, are transferred from the printed circuit board to the electrical connector, which in turn relays the signals to the electrical wires.

Many connectors connect electrical contacts and electrical wires by way of pinching, or sandwiching, the electrical wire between the electrical contacts and a wall of the connector housing. This is achieved, at least in part, by having an electrical contact that is formed with a spring bias member having a force component. In order to remove an electrical wire from the electrical connector, the electrical contact typically is deflected away from the electrical wire so that contact between the two no longer exists (or such that the friction between the two is small enough to allow the electrical wire to be removed). If the force constant is exceeded, the elasticity of the electrical contacts may be lost. When elasticity is lost, the electrical contact may not be able to return to its original position and the electrical contact may not be in a position to adequately make contact with the electrical wire. Thus, great care typically must be exercised when removing electrical wires from connectors to ensure that the electrical contacts within the connector maintain proper elasticity.

Additionally, many electrical connectors are not well-suited for high-voltage applications. That is, the electrical connectors may not adequately handle high voltages due to arcing between electrical contacts and insufficient barriers between electrical contacts.

Thus, a need exists for an electrical connector that maintains proper elasticity of electrical contacts housed within the electrical connector. Further, a need exists for an electrical connector that is suitable for high voltage applications.

BRIEF SUMMARY OF THE INVENTION

Certain embodiments of the present invention provide an electrical connector assembly for connecting an electrical contact to an electrical wire. The electrical connector assembly comprises a housing and anti-overstress members. The housing has a contact chamber that retains an electrical contact. The electrical contact has an elasticity over a range of motion. The anti-overstress member is provided in the contact chamber. The anti-overstress member is positioned within the range of motion to limit deflection of the electrical contact.

The electrical connector assembly further comprises a contact cover that covers one side of the contact chamber. The anti-overstress member may be on the contact cover. The electrical connector assembly also includes a hinge that allows the electrical connector assembly to open and close.

The electrical connector assembly may also comprise interweaving walls positioned on either side of the electrical contact within the contact chamber. The interweaving walls shield the electrical contact from arcing. The interweaving walls have edges with non-linear contours proximate an open bottom of the housing.

Additionally, a contact deflection member may be provided in the housing. The contact deflection member deflects the electrical contact along the range of motion until the electrical contact abuts against the anti-overstress member. Optionally, the electrical connector assembly may include a deflection channel allowing passage of a tool to deflect the electrical contact.

Figure 1:
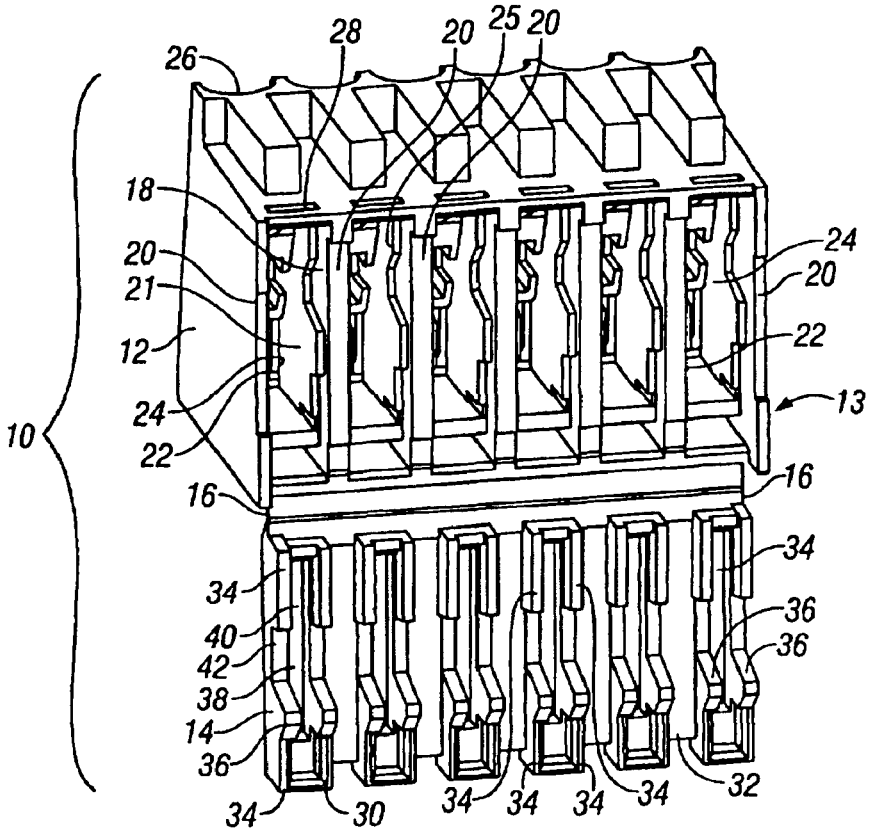
FIG. 1 illustrates an isometric view of an electrical connector formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric view of an electrical connector 10 formed in accordance with an embodiment of the present invention. The electrical connector 10 includes a contact housing 12 and a contact cover 14, which may be formed integrally with the contact housing 12. The contact housing 12 connects to the contact cover 14 through a living hinge 16, which allows the contact cover 14 to pivot in order to open and close the electrical connector 10.

The contact housing 12 includes an open end 13 exposing contact chambers 18 that receive and retain electrical contacts (discussed below). The electrical contacts may be loaded into the contact chambers 18 through the open end 13. Alternatively, the open end 13 may be positioned on the sides or top of the contact housing 12, such that electrical contacts may be loaded into the contact housing 12.

Each contact chamber 18 is defined by two sidewalls 20 and a backwall 22 that define an inner cavity 24 into which an electrical contact is positioned. The sidewalls 20 and the backwalls 22 include built-out portions 21 on interior surfaces of the sidewalls 20 (within the cavities 24). The built-out portions 21 include interweaving elements 25 that allow for proper mating with corresponding features (interweaving walls 34 and anti-overstress members 36) on the contact cover 14 (discussed below). The built-out portions 21 and interweaving elements 25 have a non linear contour that is keyed to mate with corresponding structures on the contact cover 14 (as discussed below). Each contact chamber 18 includes a wire passage (not shown) that connects with a corresponding wire trough 26. The wire passage allows a path of entry for the wire from a wire trough 26 into a corresponding contact chamber 18. Additionally, the contact housing 12 has latch engagement slots 28 that receive and retain corresponding latch members (latches 84, shown with respect to FIG. 4) positioned on the contact cover 14.

The contact cover 14 includes housing mating members 30. Adjacent housing mating members 30 may be connected to each other through a connecting member 32, which may be formed integrally with the housing mating members 30. Each housing mating member 30 is configured to mate with a corresponding contact chamber 18, such that the housing mating members 30 fit within the contact chambers 18 when mated together (that is, when the contact cover 14 is closed). Each housing mating member 30 includes interweaving walls 34 positioned at either end, an intermediate ledge 42 and anti-overstress members 36 which protrude outwardly from a base wall 38 of the contact cover 14. The interweaving walls 34, the intermediate ledge 42 and the overstress members 36, which may be formed of plastic, correspond to the interweaving elements 25 of the contact housing such that a substantially contiguous barrier is formed that encases an electrical contact. The interweaving walls 34, in conjunction with the base wall 38, define contact channels 40, which receive and retain portions of the electrical contacts.

When the contact cover 14 is closed over the contact housing 12 after insertion of electrical contacts into the contact housing 12, the anti-overstress members 36 protrude into the inner cavity 24 of the contact chamber 18. That is, the anti-overstress members 36 are thicker than the corresponding mating walls of the interweaving elements 25 of the contact chamber 18, thereby forming a shelf or ledge within the contact chamber 18. Additionally, the interweaving walls 34 may be thicker than the corresponding walls of the interweaving elements 25. Further, as discussed below, after insertion of electrical contacts into the electrical connector 10, portions of the electrical contacts are straddled by the interweaving walls 34.

Upon insertion of the electrical contacts into the contact chambers 18, the contact cover 14 pivots on the hinge 16 to engage the contact housing 12. Latch members (not shown) positioned on housing mating members 30 latchably engage the latch engagement members 28 formed within the contact housing 12. Thus, the electrical connector 10 receives and securely retains a plurality of electrical contacts.

Figure 2:
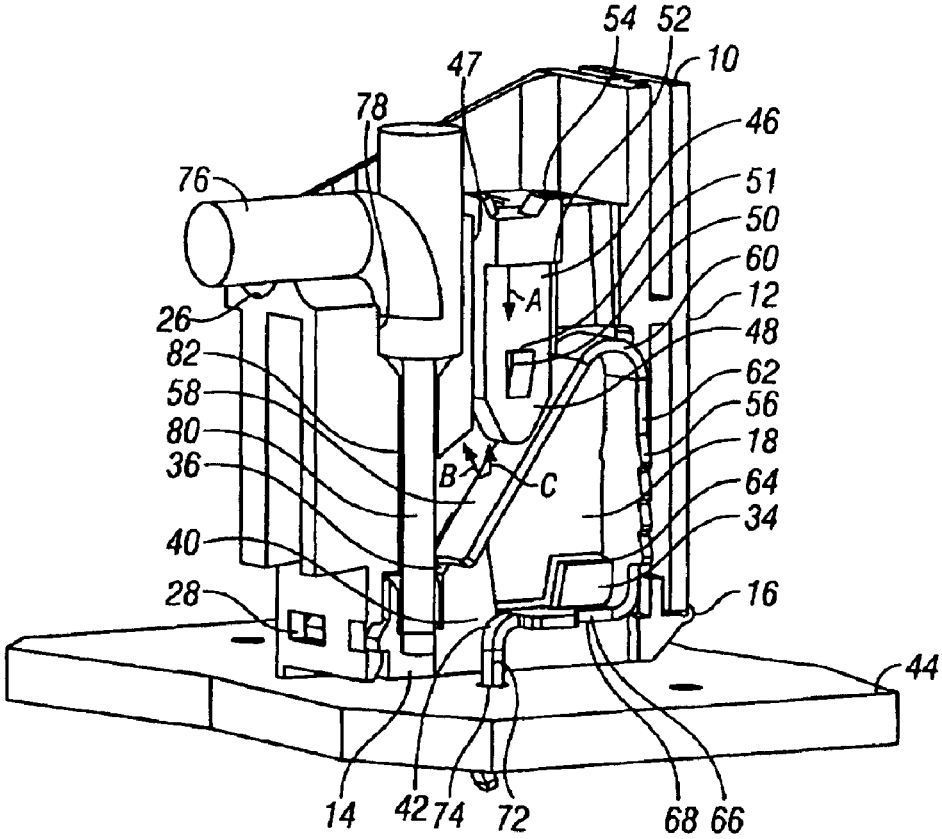
FIG. 2 is an isometric, cut-away view of the electrical connector mounted on a printed circuit board according to an embodiment of the present invention.

FIG. 2 is an isometric, cut-away view of the electrical connector 10 mounted on a printed circuit board 44, according to an embodiment of the present invention. As shown in FIG. 2, the electrical connector 10 may also include a contact-deflecting member 46 retained within a channel 47. The contact-deflecting member 46 includes a contact abutting portion 48, a ramped latching member 50 having an edge 51 and a motion limiting edge 52 and push button 54.

An electrical contact 56 is positioned within the contact chamber 18. The electrical contact 56 includes a wire contact portion 58 formed integrally with a curved transition portion 60, which is in turn formed integrally with a first retained portion 62, having a series of retained edges 64 that are engaged by features within the contact chamber 18. The first retained portion 62 is received and retained within the contact chamber 18. The first retained portion 62 is in turn formed integrally with a second retained portion 66, which is received and retained within the contact channel 40 of the housing mating member 30. The second retained portion 66 may include a shielded portion 68, which is straddled by two interweaving walls 34, an intermediate portion 70, which is received and supported by the intermediate ledge 42 of the housing mating member 30. A circuit board engaging portion 72 is formed integrally with the intermediate portion 70. The circuit board engaging portion 72, or electrical pin, is received and retained by a receptacle 74 formed within the printed circuit board 44.

As mentioned above, an electrical wire 76 may be positioned within the wire trough 26. The electrical wire 76 passes from the wire trough 26 through a wire passage 78 formed within the contact housing 12. Alternatively, the electrical wire 76 may not be supported by the wire trough 26.

The electrical wire 76 includes a stripped conducting portion 80, which passes through a channel 82. The stripped conducting portion 80 is positioned within the electrical connector 10 such that it contacts the wire-engaging portion 58. As the electrical wire 76 is further moved into the electrical connector 10, the stripped conducting portion 80 is pinched between the wire engaging portion 58 and an interior wall of the electrical connector 10. Thus, physical contact is established between the wire engaging portion 58 of the electrical contact 56 and the stripped conducting portion 80 of the electrical wire 76.

Because the electrical contact 56 and the electrical wire 76 may be in physical contact with one another, an electrical path may be established between the electrical contact 56 and the electrical wire 76. Electrical signals may pass from the circuit board engaging portion 72, through the electrical contact 56 into the wire-engaging portion 58. The electrical signal may then pass from the wire engaging portion 58 of the electrical contact 56 into the stripped conducting portion 80 of the electrical wire 80.

The electrical connector 10 is well-suited for high-voltage applications due, in part, to the interweaving walls 36. Portions of the electrical contacts 56 are positioned within the contact channels 40, such that they are sandwiched between two interweaving walls 36. The interweaving walls 36 provide a longer current path between two adjacent electrical contacts 56. Because the current path is longer, the ensuing voltage between the electrical contacts 56 may be higher. Thus, the electrical connector 10 may be used in higher voltage applications. Additionally, the interweaving walls 36 act as shields between adjacent electrical contacts 56, thus minimizing the effects of arcing between the electrical contacts. In general, the mating of the contact chambers 18 and the housing mating members 30 provide a shield and longer current path between adjacent electrical contacts. That is, the contiguous barrier formed between the contact chambers 18 and the housing mating members 30 provides an added barrier between electrical contacts. The mating of the non-linear contoured built-out portions 21 positioned on interior surfaces of the sidewalls 20 of the contact chambers 18 and the corresponding non-linear contoured interweaving walls 34 of the housing mating members 30 forms the contiguous barrier. Thus, a barrier in addition to the sidewalls 20 is formed between the electrical contacts upon the mating of the contact chambers 18 and the housing mating member 30.

FIG. 2 shows the electrical contact 56 in a deflected position. The electrical contact 56 exerts a force on the contact deflecting member 46 in the direction of line C, while the contact deflecting member 46 exerts a force on the electrical contact in the direction of line A. The electrical contact 56 has a force constant. If a force is exerted on the electrical contact 56 over a certain distance that exceeds the force constant, the electrical contact 56 may lose its elasticity. When the electrical connector 10 is fully assembled, the anti-overstress members 36 are located below, or under, wire engaging portions 58 of the electrical contacts 56. The anti-overstress members 36 are located in the range of deflection of the electrical contacts 56. The anti-overstress members 36 ensure that the electrical contacts 56 are not moved, or deflected, to a position that exceeds their force constants. That is, the anti-overstress members 36 assist in maintaining the elasticity of the electrical contacts 56, thereby ensuring that the electrical contacts 56 may properly engage corresponding electrical wires 76. The electrical contacts 56 are moved, or deflected, so that the corresponding electrical wires 76 may be removed from the electrical connector 10.

In order to release the electrical wire 76 from the electrical connector 10, the electrical contact 56 may be deflected. As mentioned above, when the electrical wire 76 is in a fully-engaged position within the electrical connector 10, the electrical wire 76 is pinched between the electrical contact 56 and an interior wall within the contact housing 12. In order to disengage the electrical wire 76, the electrical contact 56 may be deflected through the actuation of the contact deflecting member 46.

In order to disengage the electrical wire 76 from the electrical connector 10, the push button 56 is engaged in the direction of line A. That is, the push button 56 is engaged by way of a tool, such as a small screwdriver, toward the electrical contact 56. The force exerted on the push button 54 is translated to the contact abutting portion 48, which eventually contacts the wire engaging portion 58 of the electrical contact 56. The push button 56 continues to be engaged until the electrical wire 76 no longer contacts the electrical contact 56 (or until the contact is such that the electrical wire 76 may be removed from the electrical connector 10).

Similar to a spring, the electrical contact 56 has a particular force constant, or tension, past which the electrical contact 56 no longer returns to its original position. That is, if the electrical contact 56 is pushed past a certain point, the electrical contact will not return to its original position, or exert sufficient pressure to make suitable contact with the electrical wire 76. In other words, if the electrical contact 56 is pushed past a certain point, the electrical contact 56 loses its elasticity. In order to ensure that the electrical contact 56 is not overstressed (that is, pushed, or engaged past the point in which it loses its original elasticity), the electrical connector 10 includes the anti-overstress members 36. Additionally, the contact-deflecting member 46 includes the motion limiting edge 52, which helps to prevent overstressing the electrical contact 56.

As the contact-deflecting member 46 is pushed down into the electrical contact 56 in the direction of line A, the motion limiting edge 52 also travels in the direction of line A. The contact housing 12 includes a shelf (not shown). As the contact-deflecting member 46 moves in the direction of line A, it encounters the shelf. The shelf contacts the motion limiting edge 52 when the contact-deflecting member 46 reaches the downward limit of its range of motion. That is, the engaging of the motion limiting edge 52 and the shelf limits the extent to which the contact-deflecting member 46 may be moved toward the electrical contact 56. The shelf is located such that the range of motion of the contact-deflecting member 46 is halted before the contact-deflecting member 46 may push the electrical contact 56 past the point in which the electrical contact 56 loses, or substantially loses, its original elasticity.

Also, the anti-overstress members 36 form a shelf or ledge, which limits the movement of the electrical contact 56. In a fully deflected position, the electrical contact 56 abuts against the anti-overstress members 36. The anti-overstress members 36 are positioned so that the electrical contact 56 is not pushed past the point in which the electrical contact 36 loses, or substantially loses, its original elasticity.

Once the electrical contact 56 is deflected enough to allow the electrical wire 76 to be removed, the electrical wire 76 may be removed. After the electrical wire 76 is removed, the contact-deflecting member 46 is disengaged. As the contact-deflecting member 46 is disengaged, the electrical contact 56 moves back to its original position through line B, thereby exerting a force on the contact-deflecting member 46 in the direction of line C. Thus, the electrical contact 56 exerts a force on the contact-deflecting member 46 and pushes the contact-deflecting member 46 back to its original position. The ramped latching member 60 of the contact-deflecting member 46 ensures that the contact-deflecting member 46 is not ejected from the channel 47. That is, the edge 51 of the ramped latching member 60 abuts against, or latches onto, a feature within the contact housing 12 that halts the progress of the contact-deflecting member 46 in the direction of line C.

Figure 3:
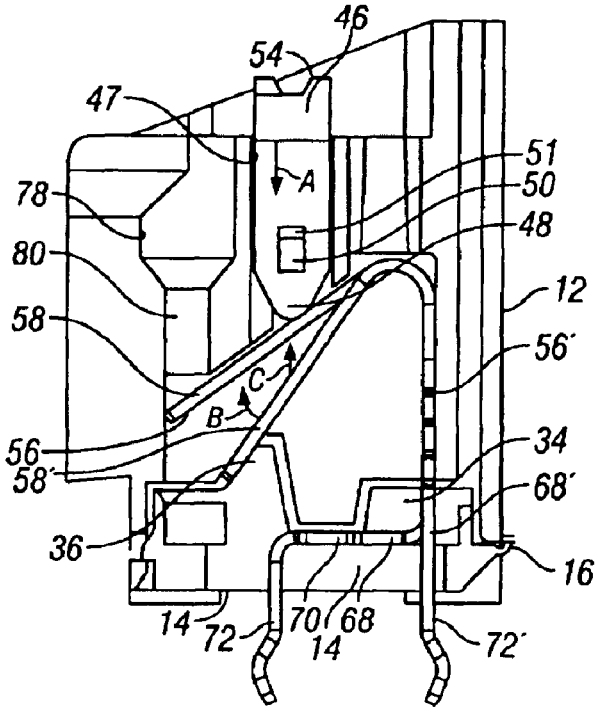
FIG. 3 is a transverse cross-sectional view of the electrical connector according to an embodiment of the present invention.

FIG. 3 is a transverse cross-sectional view of the electrical connector 10, according to an embodiment of the present invention. FIG. 3 includes the electrical contact 56 and an electrical contact 56'. The electrical contact 56' is similar to the electrical contact 56 in that both carry electrical signals. The electrical contact 56', however, does not include an intermediate portion, such as intermediate portion 70. Rather, instead of having an intermediate portion 70 that is parallel to the plane of the base wall 38 of the contact cover 14, the shielded portion 68' is formed integrally as a straight, or relatively straight, segment, with the circuit board engaging portion 72'. The contacts 56 and 56' are staggered so that arcing between the two electrical contacts 56 and 56' may be minimized. The electrical connector 10 houses a plurality of electrical contacts 56 and 56'. An electrical contact 56 is not immediately adjacent to another electrical contact 56. Rather, each electrical contact 56 is immediately adjacent to at least one electrical contact 56', and vice versa. Alternatively, the electrical connector 10 may house only electrical contacts 56 or 56'.

As shown in FIG. 3, the electrical contact 56' is in a fully deflected position, while the electrical contact 56 is in an undeflected position. Electrical wires 76 are not shown in FIG. 3. Further, for the sake of visual clarity, the contact-deflecting member 46 that deflects the electrical contact 56' is not shown.

Figure 4:
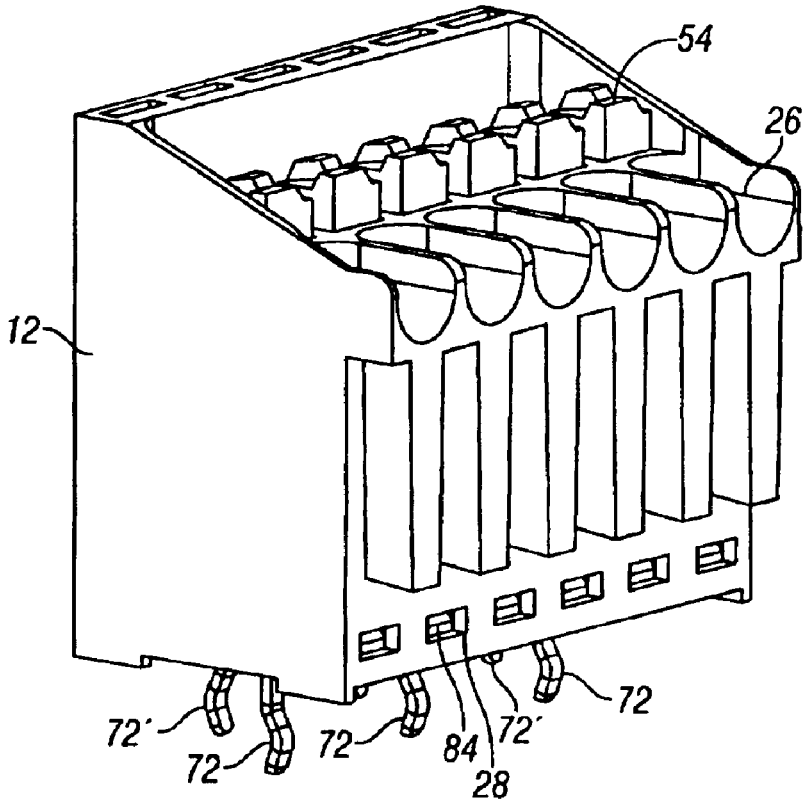
FIG. 4 is an isometric view of a fully-assembled electrical connector according to an embodiment of the present invention.

FIG. 4 is an isometric view of a fully-assembled electrical connector 10, according to an embodiment of the present invention. FIG. 4 shows the latchable engagement of the latch engagement member 28 with latches 84 formed on the housing mating members 30.

Figure 5:
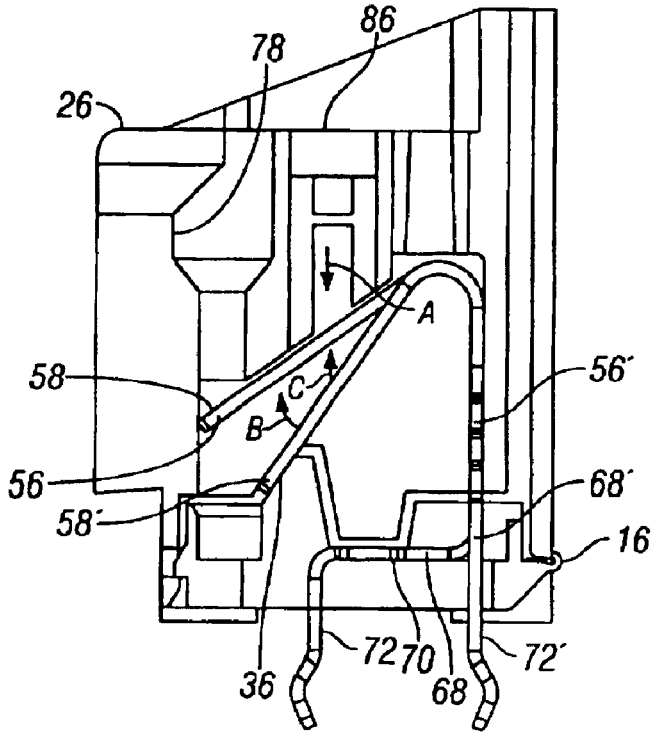
FIG. 5 is a transverse cross-sectional view of an electrical connector according to an embodiment of the present invention.

FIG. 5 is a transverse cross-sectional view of an electrical connector 10, according to an embodiment of the present invention. As shown in FIG. 5, the electrical connector 10 does not require the contact deflection member 46. Rather, a tool, such as a small screwdriver (or another electrical wire) may be inserted into the passage 86. The tool may be moved in the direction of line A until it contacts an electrical contact. The tool may then be used to push the electrical contact downward. The anti-overstress members 36 limit the movement of the electrical contacts, such that the electrical contacts may not be moved past the anti-overstress members. Thus, the elasticity of the electrical contacts 56 and 56' may be maintained.

Embodiments of the present invention may be used with a wide variety of electrical equipment. For example, embodiments of the present invention may be used in high-voltage applications such as connecting components of fluorescent lighting ballasts. The interweaving walls 34 of the electrical connector 10 create a longer current path between electrical contacts 56 and/or 56', thereby increasing the amount of voltage that may be applied within the electrical connector 10. That is, by shielding adjacent contacts from one another by retaining contacts between interweaving walls, a longer current path between the contacts exists, and therefore, a higher voltage may be applied. Further, the anti-overstress members 36 within the electrical connector ensure that the electrical contacts maintain adequate elasticity to return to normal contact positions after deflection.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly for connecting a plurality of electrical contacts to electrical wires, said electrical connector assembly comprising:

a housing having a plurality of contact chambers that retain said electrical contacts, said electrical contacts having an elasticity over a range of motion; and an anti-overstress member provided in each of said contact chambers, each said anti-overstress member being positioned within said range of motion to limit deflection of each said electrical contact.

2. The electrical connector assembly of claim 1 further comprising a contact cover secured to said housing through a hinge that permits said contact cover to pivot to open and close one side of each said contact chamber, each said anti-overstress member being on said contact cover.

3. The electrical connector assembly of claim 1 further comprising a contact deflection member provided in each said contact chamber, said contact deflection member deflecting each said electrical contact along said range of motion until each said electrical contact abuts against a corresponding said anti-overstress member.

4. The electrical connector assembly of claim 1 further comprising built-out portions on interior surfaces of said housing and a cover having interweaving walls, said built-out portions and interweaving walls having edges with non-linear contours that mate with one another.

5. The electrical connector assembly of claim 1 further including a wire passage formed within said housing to permit an electrical wire to be inserted through said wire passage into said contact chamber until contacting a wire-engaging portion of said electrical contact.

6. The electrical connector assembly of claim 1 wherein each of said plurality of said contact chambers retains a single corresponding electrical contact, said contact chambers being separated by sidewalls forming continuous barriers to isolate each of said electrical contacts from one another, said sidewalls shielding said electrical contacts from arcing with one another.

7. The electrical connector assembly of claim 1 wherein said housing comprises an interior wall, a wire-engaging portion of said electrical contact being positioned within said contact chamber to pinch the electrical wire against said interior wall once the electrical wire is inserted into the contact chamber.

8. An electrical connector assembly, comprising:

a housing having a plurality of contact chambers separated by sidewalls;

a plurality of electrical contacts loaded into corresponding separate and individual contact chambers, said sidewalls isolating each of said electrical contacts from one another;

built-out portions provided along interior surfaces of said sidewalls, said built-out portions being positioned on either side of each of said plurality of electrical contacts, said interweaving walls forming an additional barrier against arcing between said plurality of electrical contacts; and an anti-overstress member provided in each said contact chamber, each of said anti-overstress members being positioned within a range of motion of a corresponding one of said plurality of electrical contacts to limit deflection of said plurality of electrical contacts.

9. The electrical connector assembly of claim 8 further comprising a contact cover that covers one side of each said contact chamber, said contact cover including interweaving walls, said interweaving walls and built-out portions having non-linear contours that mate with one anther.

10. The electrical connector assembly of claim 8 mounted on a printed circuit board, said electrical connector transferring signals between said printed circuit board and a plurality of electrical wires.

11. The electrical connector assembly of claim 8 further including a cover joined to said housing with a hinge that allows said cover to open and close said contact chambers.

12. The electrical connector assembly of claim 8 wherein said housing comprises an open bottom to permit loading of electrical contacts and a cover closing said open bottom, said cover including anti-overstress members limiting deflection of said electrical contacts.

13. The electrical connector assembly of claim 8 further including wire passages allowing electrical wires to pass into said electrical connector.

14. An electrical connector assembly comprising:

a housing having a plurality of contact chambers defined by walls, each said contact chamber retaining an electrical contact having an elasticity, each said contact having a wire-engaging portion, and an anti-overstress member provided in each said contact chamber, said anti-overstress member being positioned within said contact chamber to limit deflection of said wire-engaging portion of said electrical contact so that said electrical contact maintains said elasticity.

15. The electrical connector assembly of claim 14 wherein each said electrical contact is positioned to pinch an electrical wire between said wire-engaging portion of said electrical contacts and one of said walls within said contact chamber.

16. The electrical connector assembly of claim 14 further comprising at least one contact deflection member for deflecting said electrical contacts to release an electrical wire pinched by said wire-engaging portion of said electrical contacts.

17. The electrical connector assembly of claim 14 further comprising a contact cover that covers one side of said contact chambers, each said anti-overstress member being provided on a wall of said contact cover.

18. The electrical connector assembly of claim 14 further including a cover joined by a hinge to said contact chamber to open and close said contact chambers.

19. The electrical connector assembly of claim 14 further comprising sidewalls positioned on either side of said electrical contacts within each said contact chamber, said sidewalls shielding said electrical contacts from arcing.

20. The electrical connector assembly of claim 14 wherein said housing comprises an open bottom to permit loading of electrical contacts.

21. The electrical connector assembly of claim 14 further comprising sidewalls with built-out portions having edges with non-linear contours proximate an open bottom of said housing, and a cover mating with said edges.

* * * * *